United States Patent [19]

Jones

[11] 4,057,289

[45] Nov. 8, 1977

[54] ROCKABLE AGAINST-THE-WALL TYPE RECLINING CHAIR

[76] Inventor: W. Dale Jones, 7020 Aztec Drive, NE., Albuquerque, N. Mex. 87110

[21] Appl. No.: 720,244

[22] Filed: Sept. 3, 1976

[51] Int. Cl.[2] ..... A47C 3/02

[52] U.S. Cl. ..... 297/259; 297/270; 297/DIG. 7

[58] Field of Search ..... 297/259, 261, 270, 271, 297/DIG. 7

[56] References Cited

U.S. PATENT DOCUMENTS

| | | | |
|---|---|---|---|
| 3,295,885 | 1/1967 | Barksdale | 297/271 X |
| 3,730,585 | 5/1973 | Rogers et al. | 297/DIG. 7 |
| 3,758,151 | 9/1973 | Re | 297/259 X |

*Primary Examiner*—James C. Mitchell
*Attorney, Agent, or Firm*—Learman & McCulloch

[57] ABSTRACT

A reclining chair capable of rocking movement upon its base which may be arranged in a position closely adjacent the wall of the room. A carriage is mounted upon the stationary base of the chair assembly for forward and rearward sliding movement upon the base. The chair frame is rockably mounted upon the carriage and supports in turn, by conventional reclining linkage, the reclining seat and back portions of the assembly. A translation linkage, actuated by the reclining linkage, is employed to shift the carriage and chair frame forwardly on the base in response to reclining movement of the seat and back so that the back does not strike the wall as it reclines. The translation linkage may be uncoupled from the chair base when it is desired to rock the chair. Upon uncoupling the translation linkage, the carriage and chair frame slide forwardly by gravity upon the base to thereby provide clearance from the wall to accommodate rocking movement.

An alternative form of the invention constitutes a conversion unit for converting a conventional rockable recliner to an against-the-wall type unit.

11 Claims, 10 Drawing Figures

ROCKABLE AGAINST-THE-WALL TYPE RECLINING CHAIR

BACKGROUND OF THE INVENTION

Reclining chairs have been popular for many years and numerous patents have been granted on linkages especially designed to support a chair seat and back, and frequently a foot rest, upon a chair frame for movement between a normal upright position and a reclined position. Subsequent developments in this field have provided such chairs with the capability of being rocked — essentially by mounting the original reclining chair upon a separate base unit for rocking movement.

One of the drawbacks of such chairs is the fact that they are almost invariably of bulky construction, the bulk being necessitated by constructions which accommodate and at the same time largely conceal the reclining linkage. A further drawback arose because of the necessity to provide sufficient clearance behind the chair for reclining movement of the chair back. The rearward movement of the upper portion of the chair back during reclining movement required the chair to be located at least a minimum distance of about one foot from the nearest wall. This requirement, combined with the normal bulk of the chair, posed problems in furniture arrangement.

In recent years, the industry has developed what is generally referred to as in against-the-wall type reclining unit in which the chair seat is shifted forwardly on the frame as the chair is reclined so that the upper portion of the chair back does not move rearwardly as the chair is reclined. In such units, the chair seat is normally mounted for rolling movement forwardly on the chair base and is driven in forward movement by means of a so-called translation linkage. The translation linkage is coupled to and actuated by the reclining linkage to drive the chair frame forwardly on the base as the chair is reclined.

However, prior to the present invention, such against-the-wall type units have not had any capability of rocking, because the translation linkage necessary to eliminate the wall clearance problems has inherently prevented rocking of the chair unit upon its base.

The present invention is especially designed to provide a rockable against-the-wall type reclining chair of a minimum height.

SUMMARY OF THE INVENTION

In its preferred form, the present invention takes the form of a chair assembly having a relatively low stationary base. A carriage is mounted on the base by means of a roller track arrangement which is inclined toward the front of the chair so that the carriage normally will be biased by gravity to a forward end limit of movement relative to the base. A chair frame is rockably supported upon the carriage and the reclining seat, back (and in some cases foot rest) are in turn supported upon the chair frame by conventional reclining linkage. A translation linkage is coupled to be actuated by the reclining linkage and is also coupled to the chair frame and the base.

A releasable latch is employed to couple the translation linkage to the stationary base of the chair. When so coupled, the unit functions in the same manner as a conventional against-the-wall type recliner. In this particular coupled relationship, the unit is not capable of rocking movement.

Upon releasing the latch coupling the translation linkage to the base, the carriage moves by gravity forwardly to its forward end limit of movement relative to the base, and with the translation linkage uncoupled from the base, the chair frame can then be rocked upon the carriage. A roller and track arrangement is provided which is engageable between the base and the chair frame to prevent rocking movement of the frame until the carriage is closely adjacent its forward end limit of movement. The chair may also be reclined when the translation linkage is unlatched from the base, thus providing both rocking and reclining capability.

In an alternative form of the invention, a conventional rockable recliner can be converted to have against-the-wall type location capabilities. In this arrangement, the rocking coupling between the conventional chair frame and its base is disconnected and the chair frame is remounted for rocking movement upon a carriage. Inclined tracks are then installed on the original chair base, the tracks being provided with a detent-like arrangement to normally locate the carriage in a rearward end limit of movement relative to the base. Upon the initiation of either a rocking or reclining movement, the carriage is uncoupled from its detent and rolled, by gravity, to its forward position, at which time either rocking or reclining of the chair can take place with sufficient wall clearance provided at the rear.

Other objects and features of the invention will become apparent by reference to the following specification and to the drawings.

IN THE DRAWINGS

Figure 2:
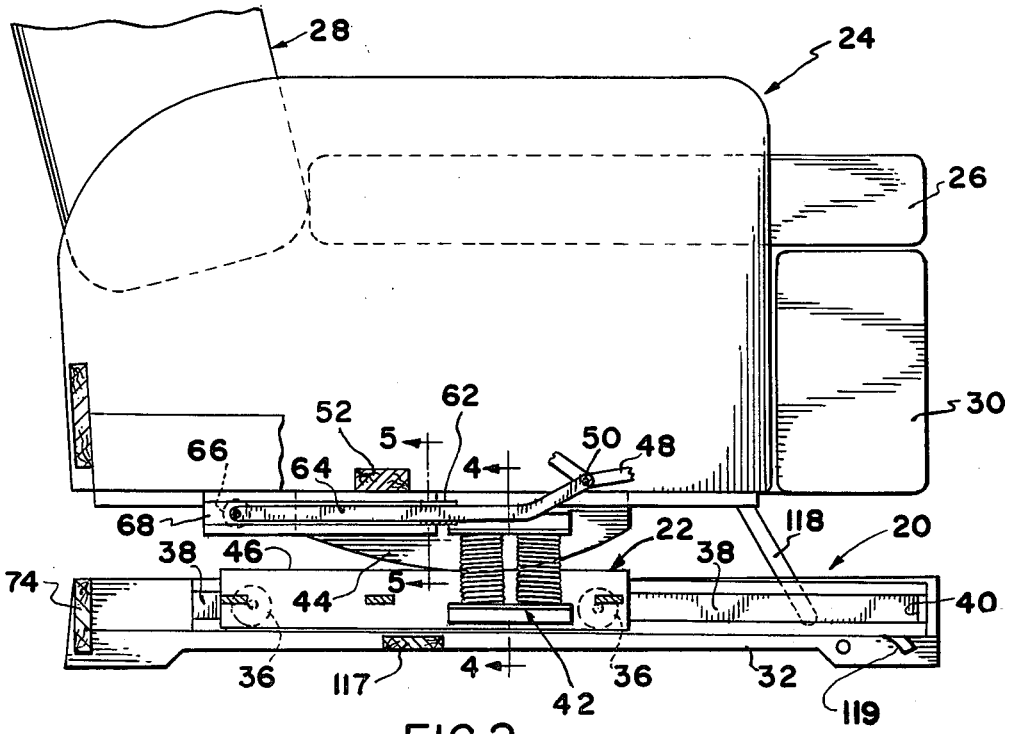
FIG. 2 is a side elevational view taken on line 2—2 of FIG. 1, with certain parts broken away or shown in section.

Referring first to FIG 2, the major components of a rockable against-the-wall type reclining chair according to the present invention include a stationary base designated generally 20, a carriage 22, a chair frame designated generally 24, a chair seat designated generally 26, and a chair back designated generally 28. In many instances, the unit may also include a foot rest designated generally 30, however, the presence or absence of a foot rest has no direct bearing on the present invention.

Figure 1:
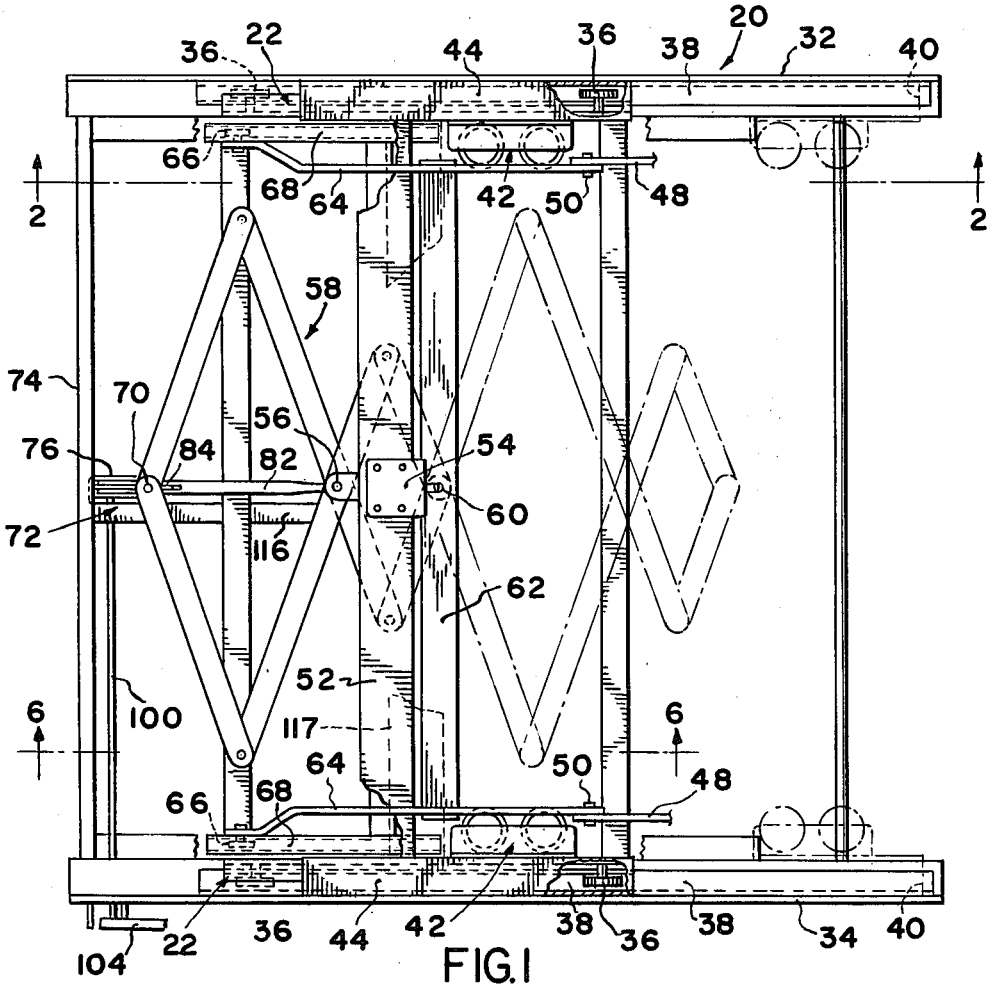
FIG. 1 is a top plan view, with certain parts broken away, omitted, or shown in section, of a chair embodying the present invention.

Carriage 22, as best seen in FIG. 1, extends transversely between a pair of side frame members 32, 34 of base 20 and is supported upon side members 32 and 34 by a plurality of rollers 36 which are received in roller support tracks 38 mounted on the interior surfaces of side frame members 32 and 34. As best seen in FIG. 2, tracks 38 are inclined downwardly toward the front of the chair so that if carriage 22 is free to move it is gravitationally biased toward the front of the chair base (to the right as viewed in FIG. 2) until it engages carriage stops 40 at the front end of tracks 38.

Chair frame 24 is supported upon carriage 22 by a pair of twin spring rocker units 42 and by a pair of rocker elements 44 fixedly secured to chair frame 24 and resting upon a flat rocking surface 46 of carriage 22.

The chair seat 26 and back 28 (and foot rest 30 where present) are supported upon chair frame 24 by a conventional reclining linkage, only a portion of which has been illustrated at 48 in FIG. 2. The exact configuration of reclining linkage 48 may take any of several commercially available forms, the only essential requirements of the linkage in the present arrangement being that it have a pivot point such as 50 which moves forwardly of the chair (to the right as viewed in FIG. 2) when the chair is moved from the upright position shown in FIG. 2 toward a reclined position. Many examples of such linkages are shown in the prior art and further details of linkage 48 have been omitted for the sake of clarity, because such linkages are well known to those skilled in the art.

Figure 6:
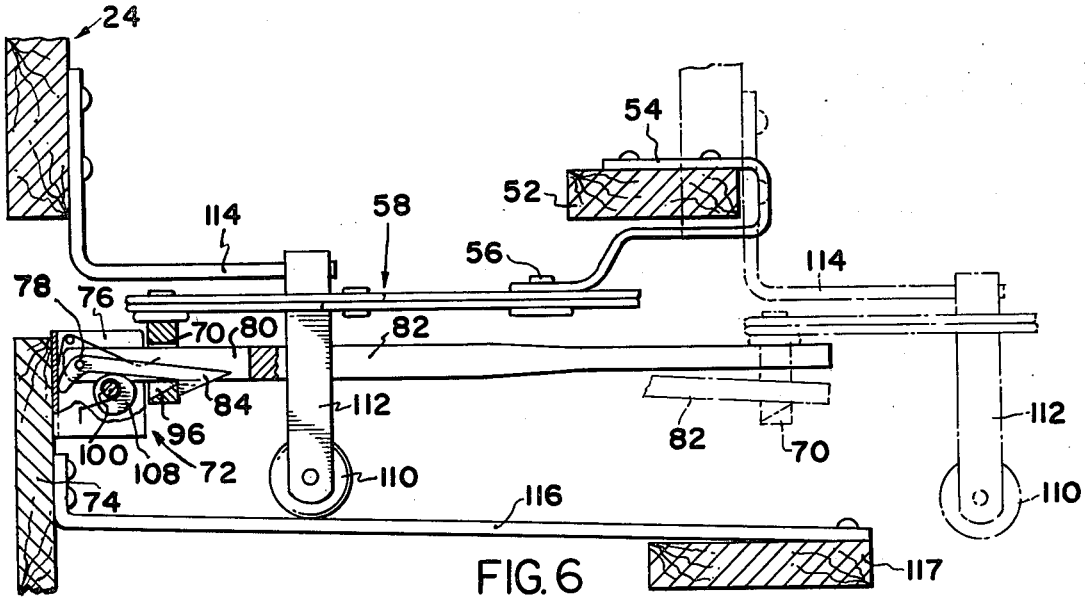
FIG. 6 is a detail cross-sectional view taken approximately on line 6—6 of FIG. 1.

Referring now particularly to FIGS. 1 and 6, it is seen that chair frame 24 includes, among other elements, a cross member 52. A bracket 54 is fixedly mounted upon cross member 52 and suspends from cross member 52 a pivot 56 which also pivotally interconnects the central cross links of a translation linkage designated generally 58. Translation linkage 58 may be generally described as a lazy tong-like linkage.

Figure 5:
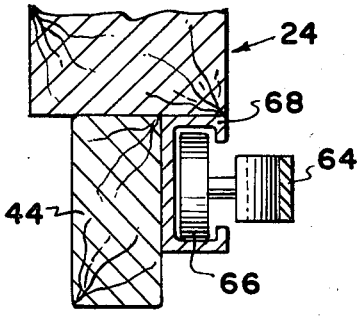
FIG. 5 is a detail cross-sectional view taken on line 5—5 of FIG. 2.

A second pivot 60 of translation linkage 58 is connected to a coupling element 62 which extends transversely of the assembly and is fixedly coupled at opposite ends to each of a pair of coupling links 64. The forward end of each link 64 is pivotally connected to pivot 50 of the reclining linkage 48, while the rearward end of each coupling link 64 is supported by a roller 66 (FIGS. 1, 2, and 5) which rides in a track 68 mounted on chair rame 24, see particularly FIG. 5. The third central pivot 70 of translation linkage 58 is coupled by a latch coupling structure designated generally 72 to a rear cross frame member 74 which forms a part of stationary base 20.

When pivot 70 of translation linkage 58 is coupled to base frame cross member 72 as shown in FIG. 1, movement of the seat and back of the chair from their upright position toward their reclined position causes pivots 50 of the reclining linkage 48 to move forwardly — i.e. toward the right as shown in FIGS. 1 and 2 — and this action pulls coupling links 64 forwardly. The forward movement of coupling links 64 is transmitted by coupling member 62 to pivot 60 of the translation linkage and pivot 56 must follow this forward movement. Forward movement of pivot 56 is directly transmitted to chair frame 24 via bracket 54 which is coupled to cross member 52 of chair frame 24. The amount of forward movement of chair frame 24 for a given amount of forward movement of pivots 50 of the reclining linkage is dependent upon the ratio of the lengths of the various links of translation linkage 58.

Figure 7:
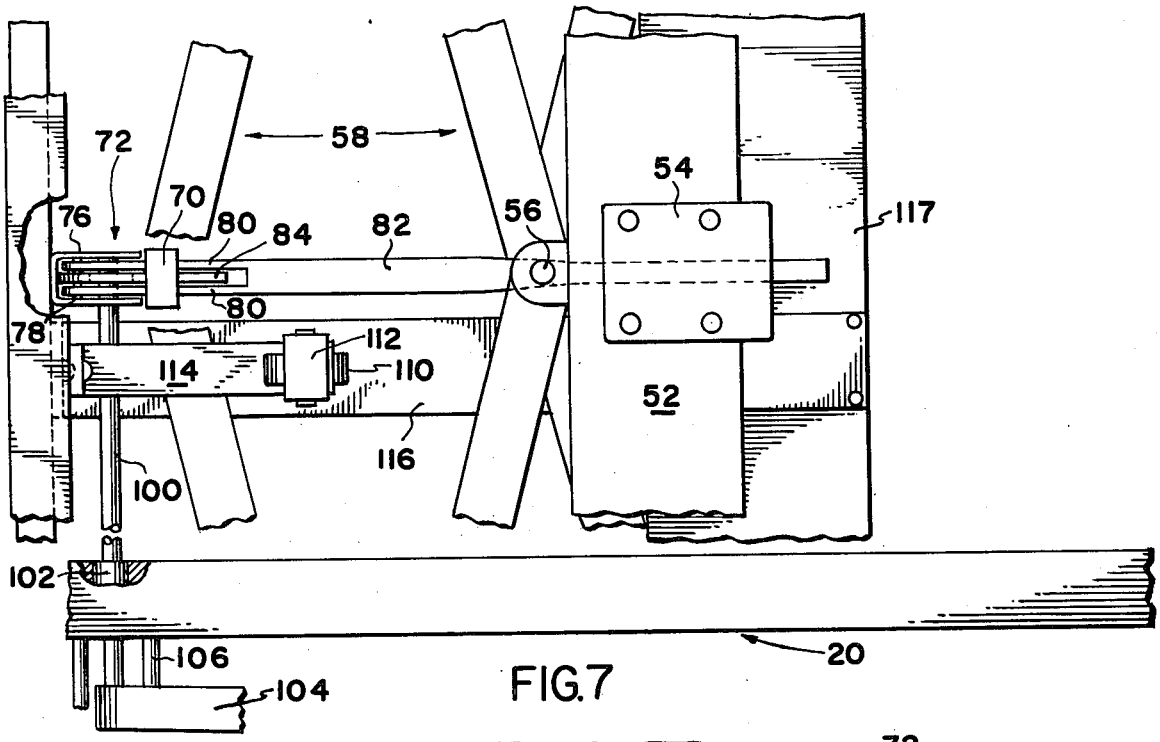
FIG. 7 is a detail top plan view with certain parts broken away of the translation linkage and latch assembly.
Figure 8:
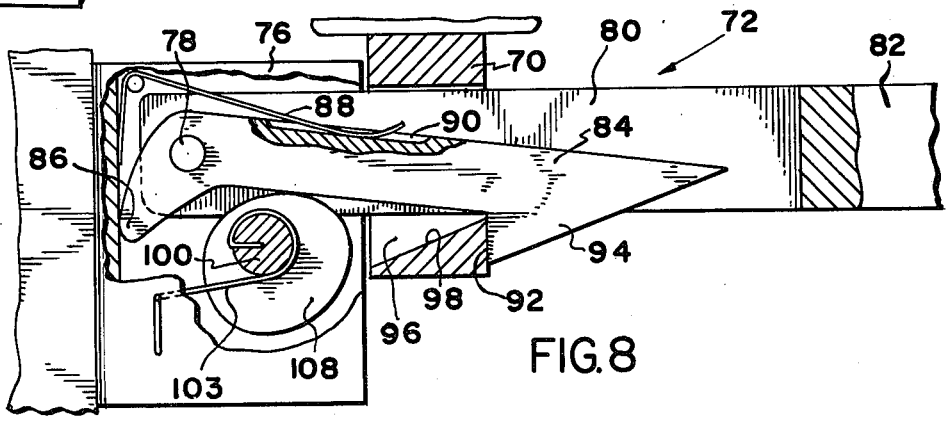
FIG. 8 is a detail side elevational view, with certain parts broken away or shown in section, of the latch assembly.

The structure of latch assembly 72 is best seen in FIGS. 6 -8. Referring first particularly to FIGS. 6 and 7, the latch assembly includes a generally U-shaped bracket 76 which is fixedly secured to rear cross frame member 74 of base 20. A pivot pin 78 is mounted in and extends between the opposite legs of U-shaped bracket 76 and pivotally supports the bifurcated legs 80 of a guide rod 82. Also pivotally mounted on pin 78 between the lgs 80 is a latch member 84.

Referring now particularly to FIG. 8, which is an enlarged view, it is seen that latch member 84 is formed with a toe portion 86 at one end engageable with the base portion of U-shaped bracket 76 to limit downward (clockwise as viewed in FIG. 8) movement of latch member 84 about pivot pin 78. Latch member 84 is normally biased to its clockwise limit of movement by a leaf spring 88 mounted on bracket 76 and having a portion 88 seated within a slot 90 in the top of latch member 84. A latch tooth portion 92 is formed at the right hand end of member 84 as viewed in FIGS. 6 and 8 and an inclined cam surface 94 projects forwardly from the tip of tooth 92 for purposes discussed below.

As most clearly shown in FIG. 8, pivot pin 70 of translation linkage 58 is projected downwardly substantially below the linkage and a slot 96 is formed through this projection. Both the legs 80 of guide rod 82 and the sandwiched latch member 84 can project through the slot 96 as shown in FIG. 8. An inclined wall 98 is formed at the lower end of slot 96 and is slidably engageable with cam surface 94 of latch member 84 to assist in reengaging the latch member.

Structure for releasing latch member 84 from the engaged position shown in FIGS. 6 and 8 includes an actuating shaft 100 rotatably journaled in one of the side members of base 20 as at 102 (FIG. 7) and having its other end rotatably supported in the legs of bracket 76. A torsion spring 103 (FIG. 8) biases the shaft toward a clockwise limit of movement as viewed in FIG. 8, this limit being determined by the engagement of an actuating handle 104 (FIG. 7) with a stop pin 106 fixedly mounted on base 20. A cam member 108 rotatably locked to shaft 100 engages the underside of latch member 84. It is believed apparent that upon counterclockwise rotation of shaft 100 and cam 108 from the position shown in FIG. 8, the large diameter section of cam 108 engaging latch member 84 will lift the latch member so that the lower tip of tooth 92 is moved upwardly above the upper edge of slot wall 98 to thereby permit the extension of pivot 70 to be withdrawn forwardly clear of latch member 84.

Referring now to FIG. 6, assuming that latch member 84 has been disengaged from the extension of pivot 70 and pivot 70 begins to move to the right from the FIG. 6 position, guide rod 82 remains slideably engged within a slot 96 in member 70 and remains so slideably engaged throughout the entire limit of movement of translation linkage 58 relative to the base — that position illustrated in broken line in FIG. 6. The purpose of guide rod 82 is to maintain the desired alignment between element 70 and latch member 84, particularly as element 70 is returned to the latching position. This assures that the tooth portion of latch member 84 is accurately aligned with the slot in member 70 to assure re-engagement of the latch.

To prevent rearward rocking movement of the chair at a time when the carriage and chair frame are not at the rocking position, a roller and track arrangement is provided as shown in FIG. 6. A roller 110 is supported at the lower end of a leg 112 which is in turn fixedly mounted upon a bracket 114 fixedly secured to chair frame 24. Roller 110 rides upon a track 116 which is mounted upon and extends between rear cross frame member 74 of base 20 and an intermediate cross frame member 117 of base 20.

When the chair is occupied and latch assembly 72 unlatched, carriage 22 and chair frame 24 will roll forwardly on base 20 along the inclined tracks 38 which support the carriage rollers. As the carriage and chair frame thus move forward, roller 110 likewise rolls forwardly — to the right as viewed in FIG. 6 — along track 116. Roller 110 is mounted well to the rear of the axis of rocking movement of the chair frame upon carriage 22, and as long as roller 110 is supported upon the track 116, it prevents the chair frame from being rocked rearwardly. The length of the track 116 is such that when the chair frame and carriage reach their forward end limit of movement relative to the base, roller 110 has moved beyond the right hand end of track 116 to the broken line position of FIG. 6. With roller 110 disengaged from track 116, the chair frame is released for free rearward rocking movement upon carriage 22.

Figure 3:
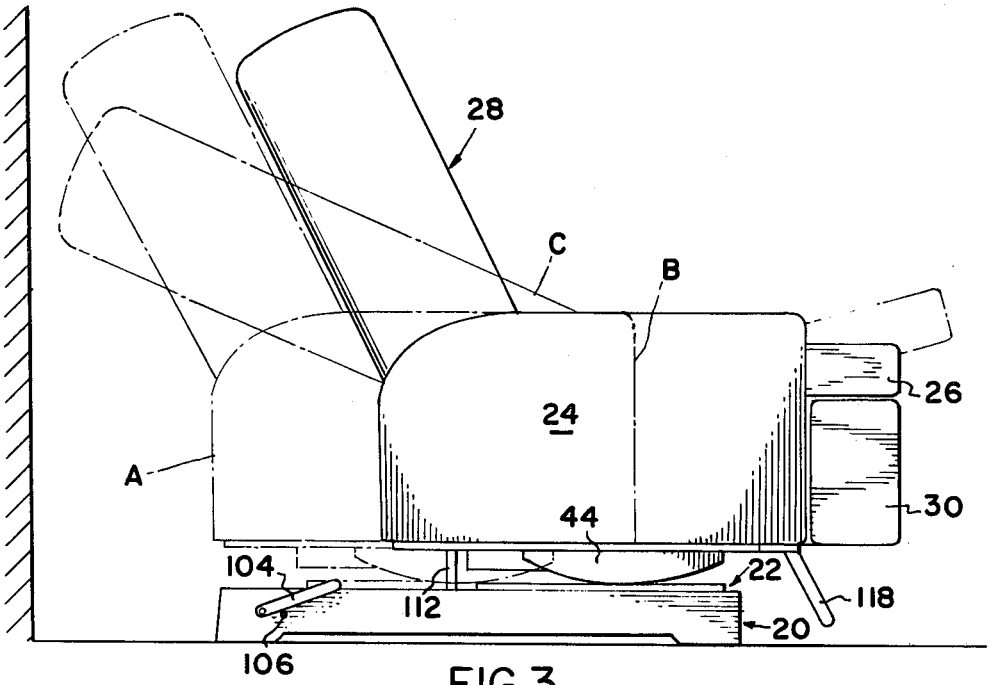
FIG. 3 is a side elevational view of a chair embodying the present invention.
Figure 4:
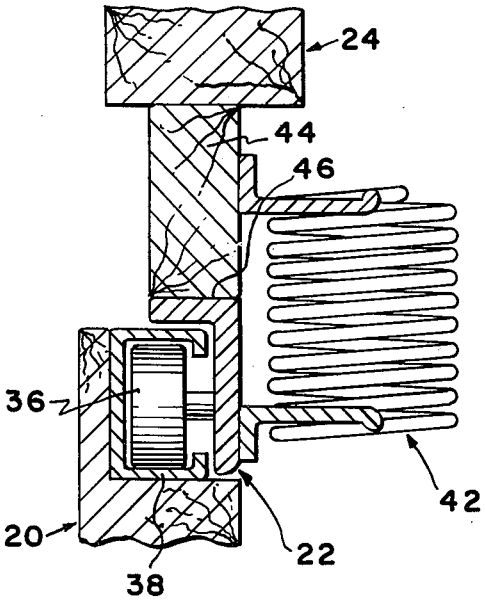
FIG. 4 is a detail cross-sectional view taken on line 4—4 of FIG. 2.

Because the chair frame is located quite far forward with respect to the base in its rocking mode, a base tilt preventer 118 (FIG. 3) is mounted on the underside of the forward edge of chair frame 24 to limit forward rocking of the chair. Unrestricted forward rocking would otherwise tend to lift the rear end of base 20 from the floor. Also, since rocking exerts a forward and rearward force on the carriage, a detent-like depression is formed near the forward end of each track 38, as by striking down a portion of the track at 119 (FIG. 2) to receive and releasably retain front rollers 36 of the carriage.

Operation of the chair as described above is as follows. It will be assumed initially that the chair is in its normal upright position (see position indicated in broken line at A in FIG. 3) with translation linkage latched by latch assembly 72 to member 74 of base 20. In this configuration, the various parts of the assembly and linkages are in the positions shown in full line in FIGS. 1, 2, 6, 7, and 8.

To recline the chair, the occupant normally leans back firmly against the chair back and this applied force causes the reclining linkage 48 to shift the seat and back toward the respective recline positions. Actuation of the reclining linkage in this manner is transmitted from its forwardly moving pivot 50 via coupling links 64 and coupling member 62 to expand translation linkage 58. This expansion of linkage 58 drives carriage 22 forwardly along the supporting tracks 38 of the base 20 so tht the chair frame moves forwardly a sufficient amount to compensate for the rearward movement of the upper portion of the back relative to the chair frame and the top of the chair back thus does not partake in any rearward movement relative to the stationary wall. The chair frame 24 moves forwardly to a position illustrated at B in FIG. 3, and, as designated by C, in this position a maximum reclination of the chair back can occur without interference with the adjacent wall surface.

Rocking cannot occur when translation linkage 58, mounted to the chair frame by means of bracket 54, has its pivot 70 latched to base cross rail 74 by structure 72. When it is desired to condition the chair for rocking, starting from the chair being in its normal upright position with translation linkage 58 latched to the base, the occupant grasps actuating handle 104 and swings this handle in a counterclockwise direction as viewed in FIG. 3 to cause cam 108 (FIGS. 6 and 8) to elevate latch member 84 to disengage latch tooth 92 from member 70. When the latch tooth is disengaged, carriage 22 rolls freely by gravity forwardly along the inclined support tracks 38 until the chair reaches the position indicated at B in FIG. 3. At this time, the rocking preventing roller 110 has moved forwardly (FIG. 6) clear of its support track 116 and the chair may thus be rocked upon rocking elements 44 with adequate clearance of the back from the adjacent wall. In this condition, the chair may also be reclined if desired.

To restore the chair to its original position, it, is necessary for the occupant (if chair is not reclined) to move the chair frame rearwardly on the base until latch member 84 re-engages with member 70 of the translation linkage. The amount of rearward movement necessary to accomplish this relatching is dependent upon the degree to which the chair is reclined, because reclining of the chair will expand the translation linkage. Preferably, the forward limit of movement established by stops 40 of carriage roller track 38 are slightly behind the maximum forward movement of the carriage front rollers which could be achieved by full actuation of the translation linkage by the reclining linkage. With stops 40 thus positioned, the chair occupant has the option of restoring the chair to its original position by fully reclining it and hence re-engaging members 84 and 70, and then sitting upright to cause the chair to automatically retract.

Figure 9:
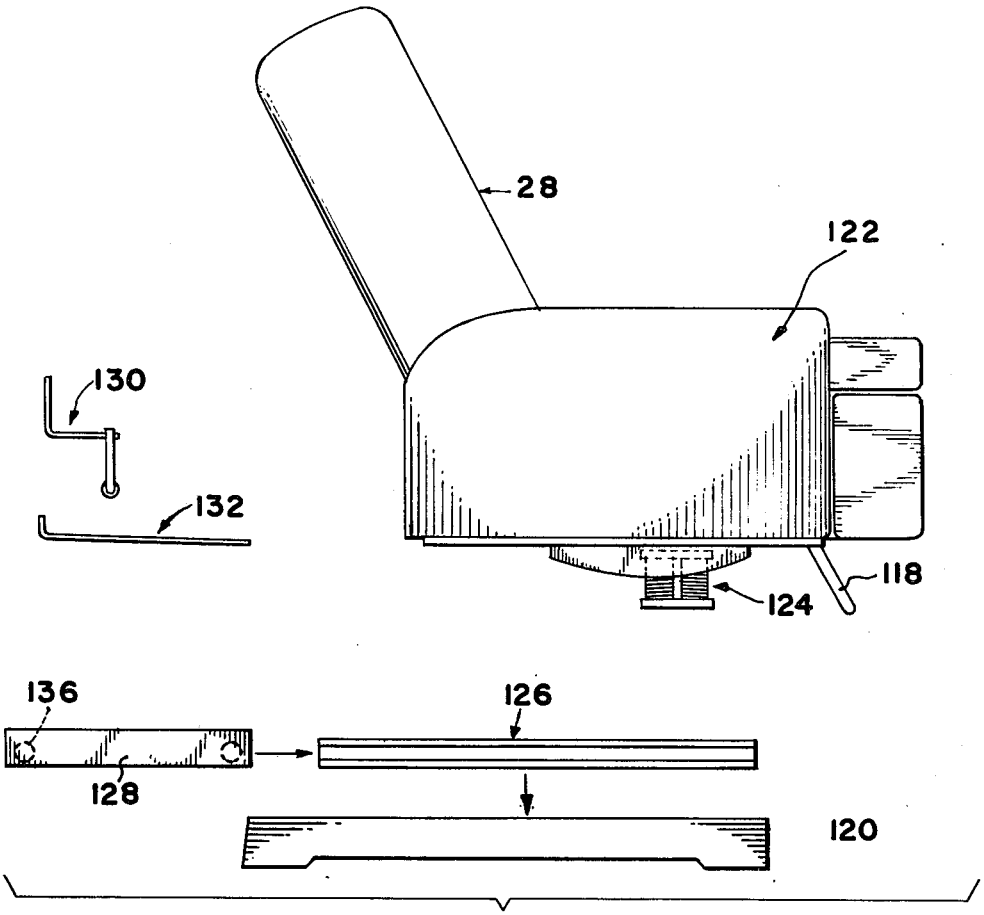
FIG. 9 is an exploded side elevational view of a modified form of the present invention.
Figure 10:
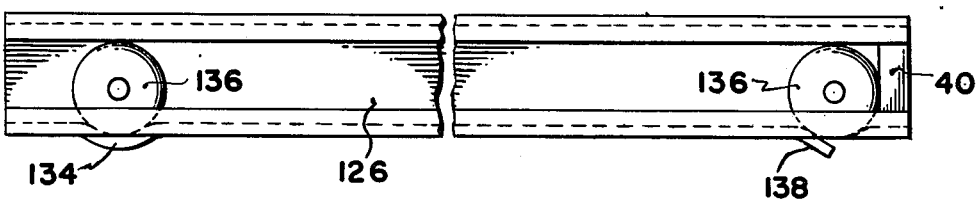
FIG. 10 is a detail side view, of the track of the FIG. 9 embodiment.

In FIGS. 9 and 10, a modified application of the invention is disclosed by means of which a conventional rocker — recliner can be converted to possess against-the-wall type capabilities.

Referring first to FIG. 9, FIG. 9 presents an exploded view illustrating the manner in which the conversion is accomplished. Elements of the conventional rocker-recliner include a base 120 and a chiar frame 122 which normally is mounted on the base 120 by a twin spring rocker arrangement designated generally 124. The units necessary to convert a conventional chair to possess against-the-wall capabilities includes a pair of support tracks 126, which are to be installed on base 120 in a downwardly inclined relationship, as were tracks 38 of the previously described embodiment. A carriage 128 of construction generally similar to the previously described carriage 22 is then assembled to the tracks 126 and the chair frame 122, which has previously been disconnected from its base 120 by detaching the twin spring rocking unit, is remounted upon carriage 128. A bracket mounted roller 130 is installed on chair frame 122 and a support track 132 for roller 130 is installed on base 120 in the same manner as roller 110 and track 116 of the previously described embodiment.

As best seen in FIG. 10, carriage support tracks 126 are formed with a detent-like depression 134 at their rearward end to receive the rearward rollers 136 of carriage 128 to establish a home position for the carriage corresponding to the normal upright configuration of the chair. The converted unit has no translation linkage analogous to the linkage 58 of the previously described embodiment, and thus forward movement of the chair frame carrying carriage 126 relative to the base to accommodate reclining or rocking of the chair relies solely upon gravity. Thus in the conversion unit illustrated in FIGS. 9 and 10, the chair occupant must move the chair frame forwardly relative to the base with sufficient force to shift the carriage wheels 136 out of their retaining depression 134 before rocking or reclining the chair.

While various embodiments of the invention have been described, it will be apparent to those skilled in the art that the embodiments disclosed may be modified. Therefore, the foregoing description is to be considered exemplary rather than limiting, and the true scope of the invention is that defined in the following claims.

I claim:

1. An against-the-wall type rackable reclining chair comprising a stationary base, carriage means mounted on said base for forward and rearward movement relative to said base between forward and rearward end limits of movement, a chair frame mounted upon said carriage means for rocking movement, a chair seat, a chair back, reclining linkage means mounting said chair seat and said chair back upon said chair frame for coordinated movement relative to said chair frame between an upright and a reclined position, and means permitting rocking movement of said chair frame on said carriage means only when said carriage is adjacent its forward end limit of movement relative to said base.

2. The invention defined in claim 1 wherein said carriage means comprises a carriage having support rollers mounted thereon and track means mounted on said base receiving said rollers, said track means being inclined forwardly and downwardly of said chair to gravitationally bias said carriage toward said forward end limit.

3. The invention defined in claim 1 further comprising translation linkage means coupled between said base, said chair frame and said reclining linkage for shifting said chair frame and said carriage means forwardly on said base in response to reclining movement of said seat and back relative to said chair frame, and latch means releasably coupling said translation linkage to said base.

4. The invention defined in claim 1 wherein said carriage means comprises a carriage frame having supporting rollers mounted thereon, inclined track means on said base receiving said carriage rollers to support said carriage means for movement along a forwardly and downwardly inclined path toward said forward end limit, and detent means for releasably retaining said carriage means at said rearward end limit of movement.

5. The invention defined in claim 1 wherein said means permitting rocking movement comprises a roller mounted on said chair frame adjacent the rearward end thereof, and a track on said base normally supportingly engaging said roller during forward and rearward movement of said carriage means on said base between said rearward end limit of movement and a position wherein said carriage means is closely adjacent its forward end limit of movement.

6. The invention defined in claim 3 wherein said latch means comprises a latch member pivotally mounted at the rearward end of said base and projecting forwardly therefrom, a coupling member on said translation linkage having a slot therethrough adapted to slidably receive said latch member, cooperative retaining means on said latch member and said coupling member operable when said latch member is pivoted upon said base to a first position to latch said coupling member to said base and operable when said latch member is pivoted to a second position to permit said latch member to be withdrawn from said slot in said coupling member upon forward movement of said carriage means relative to said base, spring means biasing said latch member to said first position, and manual means for shifting said latch member to said second position.

7. The invention defined in claim 6 further comprising guide means for guiding said latch member into said slot to accommodate movement of said coupling member into latching relationship with said latch member.

8. The invention defined in claim 7 wherein said guide means comprises a guide rod pivotally mounted on the rearward end of said base adjacent said latch member and projecting forwardly from said base, said guide rod projecting forwardly through said slot in said coupling member to be slidably received therein throughout the full range of movement of said coupling member relative to said base.

9. An against-the-wall type rockable reclining chair comprising a stationary base having a pair of spaced parallel side frame members interconnected by a rear frame member, a carriage extending transversely between said side frame members, cooperating roller and track means on said side frame members and said carriage supporting said carriage for forward and rearward movement relative to said base between front and rear end limits, a chair frame, rocker means supporting said chair frame on said carriage for rocking movement thereon, a chair seat, a chair back, reclining linkage supporting said chair seat and said chair back upon said chair frame for coordinated movement between an upright position and a reclined position, translation linkage means coupled to said reclining linkage and to said chair frame, releasable latch means coupling said translation linkage to said rear frame member, said translation linkage being operable when coupled by said latch means to said rear frame member to prevent rocking movement of said chair frame on said carriage and to drive said chair frame and said carriage in forward and rearward movement on said base coordinated with movement of said seat and back between said reclined and upright positions to locate said carriage at said front end limit of movement when said chair seat and back are in said reclined position and to locate said carriage at said rear end limit of movement when said chair seat and back are in said upright position, and control means for releasing said latch means to accommodate rocking movement of said chair frame on said carriage.

10. The invention defined in claim 9 wherein said track means is inclined downwardly toward the front of said base to gravitationally bias said carriage to said front end limit when said latch means is released.

11. The invention defined in claim 10 further comprising restraining means for preventing rearward rocking movement of said chair back when said carriage is away from said front end limit.

* * * * *